United States Patent [19]

True et al.

[11] Patent Number: 5,070,789

[45] Date of Patent: Dec. 10, 1991

[54] ELECTRIC EXPLODING BRIDGE WIRE INITIATORS

[75] Inventors: Donald C. True; Hubert J. Charron, both of Brownsburg, Canada

[73] Assignee: CXA LTD./CXA LTEE, Montreal, Canada

[21] Appl. No.: 545,816

[22] Filed: Jun. 27, 1990

[51] Int. Cl.[5] ..... C06C 5/06

[52] U.S. Cl. ..... 102/275.12; 102/202.12

[58] Field of Search ..... 102/200, 202.5, 202.7, 102/202.12, 275.6, 275.8, 275.11, 275.12

[56] References Cited

U.S. PATENT DOCUMENTS

| | | | |
|---|---|---|---|
| 3,040,660 | 6/1962 | Johnston | 102/202.5 |
| 3,100,447 | 8/1963 | Betts | 102/202.5 |
| 3,208,379 | 9/1965 | McKee et al. | 102/202.5 |
| 3,244,103 | 4/1966 | Spickard | 102/202.5 |
| 3,264,990 | 8/1966 | Betts | 102/202.7 |
| 3,264,991 | 8/1966 | Betts et al. | 102/202.7 |
| 3,288,068 | 11/1966 | Jefferson | 102/206 |
| 3,590,739 | 7/1971 | Persson | 107/275.8 |
| 4,428,292 | 1/1984 | Riggs | 102/202.7 |
| 4,586,437 | 5/1986 | Miki et al. | 102/220 |
| 4,924,774 | 5/1990 | Lenzen | 102/202.7 |

FOREIGN PATENT DOCUMENTS

| | | | |
|---|---|---|---|
| 2109512 | 6/1983 | United Kingdom | 102/275.12 |

*Primary Examiner*—Charles T. Jordan

*Attorney, Agent, or Firm*—C. Brian Barlow

[57] ABSTRACT

An exploding bridge wire (EBW) initiator assembly is provided which is particularly adapted for the initiation of an attached length of low energy shock wave conductor. The EBW comprises a hollow tube having an exploding bridge wire in one end of the tube, which directly initiates a length of shock wave conductor inserted into the opposite end of the tube. The entire assembly may be housed within a protective enclosure adapted for snap-fit connection with a source of electrical energy. The initiator can be initiated by relatively low voltage power supplies and is significantly safer then conventional EBW initiators.

16 Claims, 4 Drawing Sheets

ELECTRIC EXPLODING BRIDGE WIRE INITIATORS

This invention relates to exploding bridge wire (EBW) type electric igniters and, in particular, to EBW igniters for the ignition of low energy shock wave conductors.

Low energy shock wave conductors were first described by Persson et al. in U.S. Pat. No. 3,590,739. These fast-acting conductors comprise a hollow plastic tube having a dusting of an explosive, pyrotechnic or other reactive material on its inner surface. Upon ignition of a near end of the tube, explosive energy is conducted through the tube to its remote end where the energy is employed to initiate an attached blasting cap. Because of their low cost, convenient size, low explosive content, low noise and enhanced safety, these shock wave conductors have now replaced conventional detonating cord in a large number of non-electric blasting operations.

It is known in the industry that initiation of the explosive or pyrotechnic material in the near end of the conductor can be achieved by means of a spark discharge between two electrodes located within, or adjacent to the open end of, the shock wave conductor. In normal industry practice, however, one or a plurality of shock wave conductors is set off from a remote location by the shock wave generated by the detonation of a conventional EBW blasting cap.

Detonation of the conventional EBW cap is achieved by initiation of an explosive base charge within the cap, which initiation is caused by the "explosive" force of a disintegrating bridge wire. The bridge wire disintegration is effected by subjecting the wire to a short duration pulse of electrical energy, which causes the wire to burn rapidly and thus creates a shock wave within the EBW cap.

Detonation of a conventional exploding bridge wire cap thus provides a means for the remote, electrical initiation of a shock wave conductor by detonation of the base charge present in the EBW initiator.

A large number of electric initiators having exploding bridge wires are disclosed in the art. For example, U.S. Pat. Nos. 3,040,660, 3,100,447, 3,208,379, 3,264,990, 3,264,991, 3,288,068, 4,428,292 and 4,586,437 all describe conventional EBW caps which employ the use of a short length of a disintegrable metal wire in close proximitytto a detonatable explosive material within a metal casing. Upon application of a substantial, short duration pulse of electric current to the wire, the wire burns or "disintegrates" with sufficient force to initiate the adjacent explosive base charge. Although the bridge wire disintegrates with sufficient force to initiate the adjacent explosive base charge, the bridge wire disintegration alone is generally not sufficient to cause damage to the initiator metal shell.

Various means are known to vary the intensity and duration of the electric pulse. However, all conventional EBW caps operate by causing the detonation of the explosive base charge which base charge explodes with sufficient force to destroy the metal casing of the initiator and provide an explosive shock wave capable of initiating an adjacent length of shock wave conductor tubing.

The detonation of the explosive base charge requires that the electrical generation equipment and controls for firing the initiator are separated from the EBW cap by a safe distance since the detonation of the explosive base charge in the initiator creates a localized danger area from the explosion of the initiator.

Separating the electrical generation and control equipment from the EBW cap increases the electrical energy which is required to ensure that the EBW cap is properly detonated. The energy required to disintegrate the bridge wire, without any attached lead wires, is typically of the order of 3 joules. The voltages used for blasting, however, are typically of the order of 2000 to 4000 volts D.C. in order to overcome the resistance caused by the long leads that must be attached to the conventional EBW cap and provide the necessary 3 joules.

Surprisingly, we have now found that an exploding bridge wire initiator can be produced wherein the exploding bridge wire directly initiates the explosive/-pyrotechnic material present in the shock wave conductor tubing, without requiring the explosive base charge present in conventional EBW caps.

It is an object of the present invention to provide an exploding bridge wire initiator that is essentially immune from the explosive hazards associated with conventional electric bridge wire caps.

It is a further object of the present invention to provide an EBW initiator that reduces the amount of electrical voltage required to initiate a low energy shock wave conductor tubing.

Accordingly, the present invention provides an exploding bridge wire initiator assembly having an exploding bridge wire and a shock wave conductor, which shock wave conductor comprises a hollow elongated tube having an inner lining of a reactive material, wherein the improvement in said assembly is that said exploding bridge wire is sufficiently adjacent to said reactive material such that on actuation of said exploding bridge wire, direct initiation of said reactive material is effected.

By direct initiation is meant that the shock wave generated by the disintegration of the bridge wire will initiate the propagation of a shock wave in the shock wave conductor tubing without requiring the explosive force normally generated by the explosive base charge present in conventional EBW caps.

The exploding bridge wire is thus to be located in such a position that the force from the wire disintegration acts upon the reactive material in the shock wave conductor.

The exploding bridge wire can be located within the shock wave conductor, but in a preferred embodiment, the bridge wire is adjacent to and outside of an open end of said shock wave conductor. Although the exploding bridge wire can be located in parallel proximity (i.e. such that the bridge wire or bridge wire assembly including lead wires runs approximately parallel) to the shock wave conductor, it is preferable that the wire be located in axial alignment with an open end of the shock wave conductor.

When the bridge wire is located outside of the shock wave conductor, it is desirable that the bridge wire and one end of the shock wave conductor be located within a hollow protective member, which member defines a duct, which serves to assist in ensuring that the explosive force of the disintegrating bridge wire is transferred to the shock wave conductor and thus effects direct initiation of the shock wave conductor.

Accordingly, the present invention also provides an exploding bridge wire initiator assembly as hereinabove defined adapted for the direct initiation of a shock wave conductor, said initiator comprising a member defining a duct having a first and second open end; an insert within said duct essentially dividing said duct into a first duct area and a second duct area; an exploding bridge wire located within said first duct area; and, a shock wave conductor located within said second duct area so that an open end of said shock wave conductor is axially aligned with said bridge wire.

Preferably, the member defining the duct is a metal tube.

The maximum distance between the bridge wire and the open end of the shock wave conductor is variable and is dependent of the voltages used and the bridge wire material and size. Preferably, however, the bridge wire is located within 1 cm. of said open end.

In a further preferred embodiment, the initiator of the present invention as hereinbefore defined, additionally comprises a plug which effectively seals said bridge wire within said first duct area.

As will be readily understood by one skilled in the art, the exploding bridge wire is connected to at least two lead wires which conduct the electrical charge to initiate the bridge wire. These lead wires preferably extend from the duct through said plug.

In a more preferred embodiment, the invention provides an EBW initiator as hereinbefore defined wherein said shock wave conductor is held in said second duct area by a bushing insert located within said second duct area.

In order to separate the shock wave conductor from the exploding bridge wire to prevent damage to the EBW and to prevent explosive powder from coming into contact with the EBW, the initiator as hereinabove defined additionally comprises a particle-retaining diaphragm which separates said first duct area from said second duct area. The diaphragm also provides protection to the bridge wire prior to connecting the EBW to the shock wave conductor tubing. It will be readily understood by one skilled in the art that the diaphragm will be constructed so as to provide protection to the bridge wire without substantially reducing the explosive force of the disintegrating bridge wire. Thus, the diaphragm is also "disintegratable" in that it is effectively ruptured by the explosive force of the bridge wire explosion.

The sleeve insert and diaphragm may be inserted into the duct separately. However, in a preferred embodiment, the sleeve insert and diaphragm together form a one piece H-shaped insert. The H-shaped insert provides a cup-shaped recess within each of said first duct area and said second duct area. The exploding bridge wire is preferably located within the cup shaped recess in said first duct area.

H-shaped insert in this specification refers to a generally cylindrical insert that is H-shaped in cross section.

Since the initiator is free from detonatable explosive material, other than the small amount which is present in the shock wave conductor, the force of the bridge wire disintegrating is the most significant explosive force in the connector. Thus, the connector is not subject to an explosive force of a magnitude which will cause a hazard to an operator in the same area. If of proper proportions, the bridge wire disintegration is of low enough force for the connector to be held by hand when fired while still providing the explosive force necessary to initiate the shock wave conductor.

The EBW initiator of the present invention can thus be connected directly to the source of electrical energy used to cause the bridge wire to explode with lead wires as short as one or two cm. in length. This direct connection allows lower voltages, such as 100 volts, to be used to provide the 3 joules necessary to disintegrate the bridge wire.

Normally, and preferably, sufficiently high D.C., voltages generated by capacitance discharge, are used to initiate the EBW initiator of the present invention and thus effect direct initiation of the shock wave conductor. However, with the lower voltages used with the present EBW initiator, A.C. current can also be used provided that the firing circuit of the power supply is adapted to provide voltage to the bridge wire only when the A.C. voltage is at a level which is sufficiently high to ensure disintegration of the bridge wire. Development of a suitable A.C. firing circuit is within the capabilities of one skilled in the electronics art.

In a second aspect, the present invention also provides an exploding bridge wire initiator adapted to be connected to a shock wave conductor to provide an exploding bridge wire initiator assembly as described hereinabove.

In a further aspect, the present invention also provides an initiation assembly for use in explosive blasting operations and adapted for connection to a source of electric energy; the assembly comprising a length of shock wave conductor, an exploding bridge wire initiator according to the present invention as described hereinabove operatively connected to a first end of said shock wave conductor and a non-electric blasting cap operatively connected to a second end of said shock wave conductor.

After being initiated by the EBW initiator of the present invention, the shock wave traveling through the shock wave conductor will cause the non-electric blasting cap to detonate.

Thus, the initiator assembly of the present invention provides a significant safety improvement over the prior art since detonation of the non-electric blasting cap at one end of the shock wave conductor can be achieved without the detonation of a conventional electric blasting cap at the other end of the shock wave conductor.

Preferably, the electrically ignitable exploding bridge wire initiator is enclosed within an elongated connector body, and said connector body is adapted to receive therein electric current-carrying elements for the initiation of said exploding bridge wire initiator.

The connector is preferably made of a material such as plastic which will insulate the exploding bridge wire initiator and provide additional safety from stray electrical charges.

The connector body is also preferably manufactured so as to provide an elongated connector body for receiving therein the electrically initiated exploding bridge wire initiator as hereinbefore defined. The connector body comprises two elongated, substantially excavated mirror-image blocks adapted to form a container, the hollow inner portion of said container being so shaped so as to receive therein said exploding bridge wire initiator and lead wires connected with said exploding bridge wire, and wherein the lead wires are disposed as to permit plug-together contact with current-carrying elements.

Preferably, the plug-together contact is provided by means of elongated cavities adjacent said lead wires and disposed to receive the current-carrying elements. The elongated cavities are preferably sealed by a puncturable dust protective membrane.

The connector blocks which make up the connector body may also be joined together by a flexible connection to form a one-piece unit, which unit can be bent at the flexible connection to form the container.

In its most preferred embodiment, the invention provides an exploding bridge wire initiator, housed within a connector body. The connector body, and thus the leads to the initiator of the present invention can be rapidly connected to a battery powered, hand-held EBW initiating device and thus allows for detonation of explosives in areas where a conventional source of electrical energy is unavailable.

In a further aspect, the present invention also provides a method of initiating a shock wave conductor comprising positioning an open end of a shock wave conductor sufficiently adjacent to an exploding bridge wire and supplying sufficient voltage to said exploding bridge wire to cause said bridge wire to explode, so that the explosive force from said exploding bridge wire directly initiates said shock wave conductor.

In a still yet further aspect, the present invention also provides a method of blasting comprising placing the non-electric blasting cap of the initiation assembly of the present invention as describe hereinabove, within an explosive material, and supplying sufficient voltage to the exploding bridge initiator to cause direct initiation of the shock wave conductor.

The particular application and advantages of the present invention will become apparent from the following non-limiting description of various embodiments in conjunction with the accompanying drawings wherein.

Figure 1:
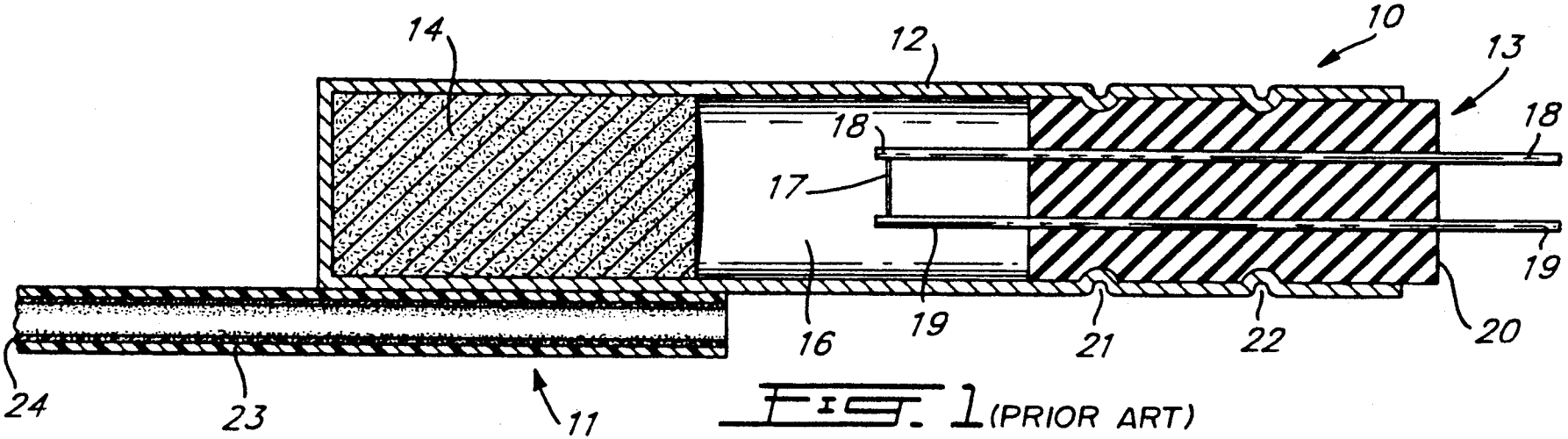
FIG. 1 (PRIOR ART)
FIG. 1 is a longitudinal cross-sectional drawing of a known EBW initiator according to the prior art, in association with a shock wave conductor.

Referring to FIG. 1, a standard EBW cap 10, known in the prior art, is shown in association with a length of shock wave conductor 11. Cap 10 comprises a cylindrical metal tube 12 with an opening 13 at one end of tube 12. At the closed end of tube 12 is a base charge 14 of pentaerythritol tetranitrate (PETN). Within the open area 16 of tube 12 is an exploding bridge wire 17 attached across the ends of leg (or lead) wires 18 and 19. Leg wires 18 and 19 extend through plug 20, which plug seals the end of tube 12. Leg wires 18 and 19 are connected to a suitable energy source (not shown) which energy source provides a pulse of electrical energy to cause bridge wire 17 to "disintegrate". Peripheral crimps 21 and 22 hold plug 20 within tube 12.

Outside of, and beside cap 10, is a length of shock wave conductor 11. Shock wave conductor 11 is comprised of a plastic tube 23 coated on its inner surface with a thin layer of a reactive or explosive material 24. Shock wave conductor 11 is aligned longitudinally with cap 10 and is held in contact with cap 10 by tape (not shown).

In operation, an electrical pulse is generated by the energy source, which pulse is passed through leg wires 18 and 19 and thus causes bridge wire 17 to disintegrate with sufficient force to detonate the base charge. The detonation of base charge 14 is of sufficient force to rupture tube 12 and allow the explosive energy of base charge 14 to escape from the confines of tube 12. The escaping explosive force is sufficient to cause initiation of the reactive material 24 within shock wave conductor 11. Once initiated, the exploding reactive material 24 within shock wave conductor 11 propagates a shock wave which travels along the length of shock wave conductor 11.

Figure 2:
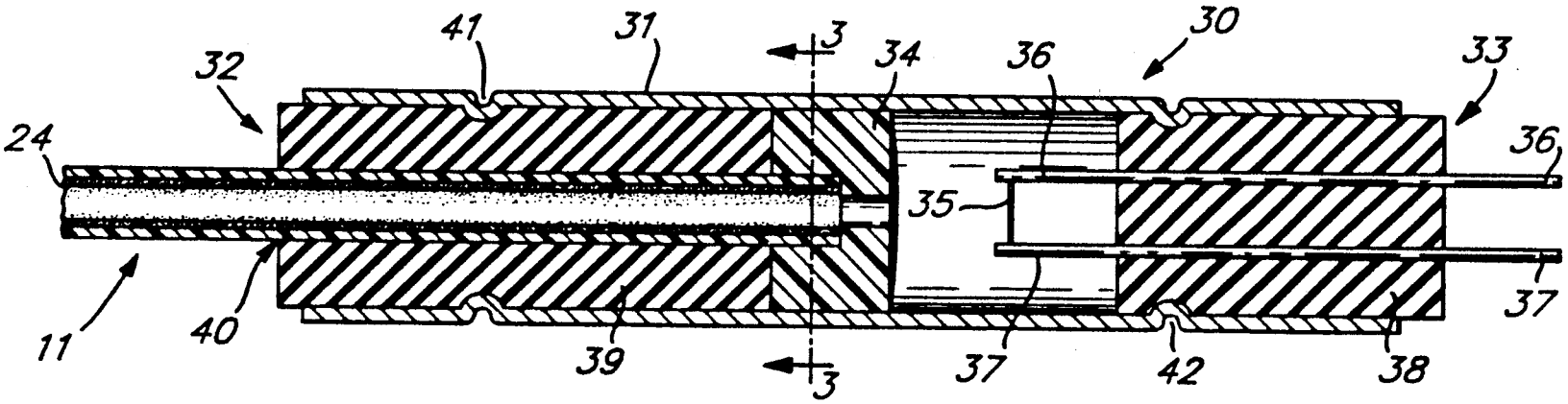
FIG. 2 is a longitudinal cross-sectional drawing of a novel EBW initiator according to the present invention, in association with a shock wave conductor.

In FIG. 2, an initiator 30 according to the present invention is shown in association with a length of shock wave conductor 11. Initiator 30 comprises a hollow metal tube 31 with openings 32, 33 at each end of metal tube 31. Located approximately mid-way within the confines of metal tube 31 is an insert 34, formed of a plastic material. Insert 34 is annularly shaped, with an annular portion of the inside of insert 34 cut away in order that insert 34 is adapted to receive one end of shock wave conductor 11.

Within the remaining open area of tube 31, and on the opposite side of insert 34 to shock wave conductor 11, is suspended a bridge wire 35 mounted between the ends of lead, or leg, wires 36 and 37. Bridge wire 35 is, preferably, a NICHROM* wire having a diameter of 0.002 inch although other suitable types and wire diameters can be employed.

Lead wires 36 and 37 are held within metal tube 31 by means of rubber plug 38 and extend through plug 38 beyond the end of tube 31. Lead wires 36 and 37 are adapted to be connected to a suitable energy source (not shown).

Abutting one edge of insert 34 is a tubular rubber closure bushing 39. The central inner passage 40 of bushing 39 is of a size which is adapted to hold tightly therein the end of a length of shock wave conductor 11. Shock wave conductor 11 is inserted into passage 40 until its leading edge enters and abuts the inner cut away portion of annular insert 34. Both plug 38 and bushing 39 are secured in place within metal tube 31 by means of peripheral crimps 41 and 42. The bridge wire 35 is thus axially aligned with shock wave conductor 11.

In operation, sufficient electrical energy is applied to wires 36 and 37 to cause bridge wire 35 to explode. The shock wave created by exploding bridge wire 35 directly initiates explosive material 24 within shock wave conductor 11 and thus propagates a shock wave which travels along the length of shock wave conductor 11.

Figure 3:
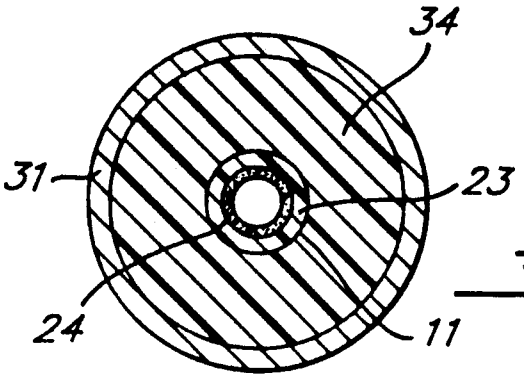
FIG. 3 is a cross-sectional view of the initiator of FIG. 2 along the line 3—3.

In FIG. 3, a transverse cross-sectional view along the line 3—3 of the initiator of FIG. 2 is shown. Within tube 31 is annular insert 34. Shock wave conductor 11 comprising a plastic tube 23 with an inner coating of reactive material 24 has been inserted into annular insert 34.

Figure 4:
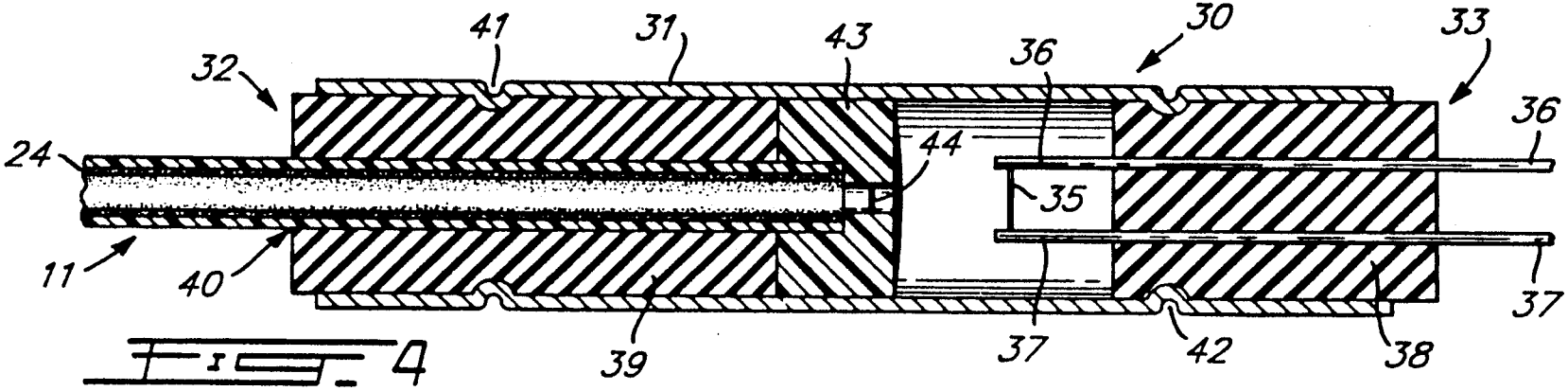
FIG. 4 is a longitudinal cross-sectional drawing of a EBW initiator of the invention comprising an H-shaped insert.

Referring to FIG. 4, the initiator shown is identical to the initiator of FIG. 2, with the exception that insert 34 of FIG. 2 has been replaced by an H-shaped insert 43, which insert 43 comprises an integral thin-wall diaphragm 44.

The diaphragm 44 in insert 43 guards against the migration of explosive/pyrotechnic powder 24 from shock wave conductor 11 into the area of the bridge wire 35. The diaphragm in this example has a thickness of 0.01 inch.

Operation of this EBW initiator is similar to the operation of the initiator described in FIG. 2. The thin walled diaphragm 44 is broken, or ruptured, by the force of the exploding bridge wire and allows the shock wave from the bridge wire to pass through to shock wave conductor 11.

Figure 5:
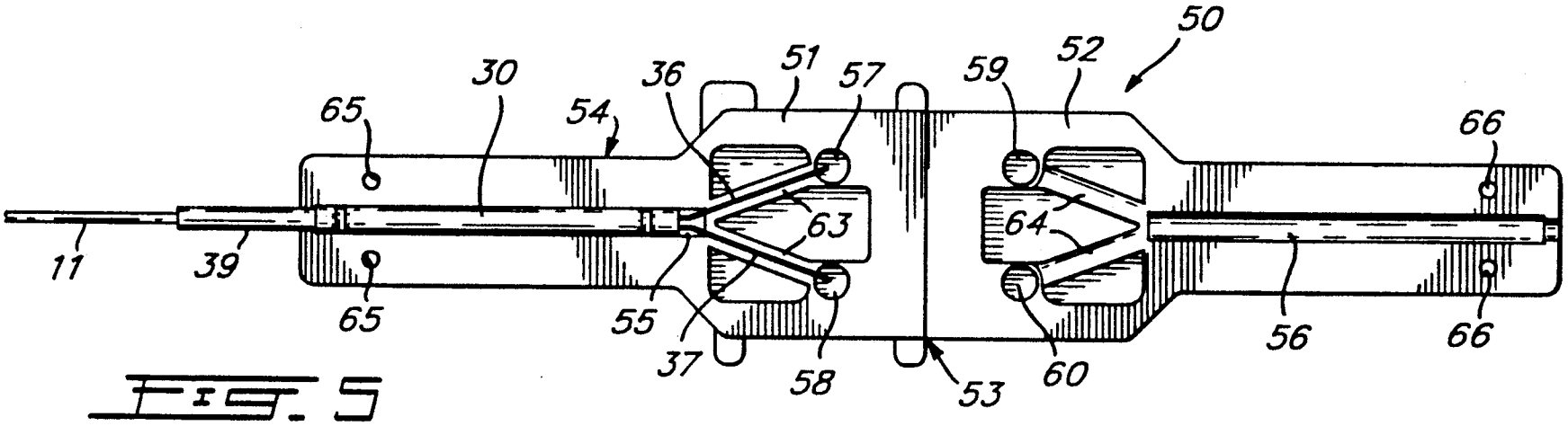
FIG. 5 is a diagrammatic plan view of an EBW initiator of the present invention and a shock wave conductor within the confines of an open protective, plug-in, insulated housing connector.
Figure 6:
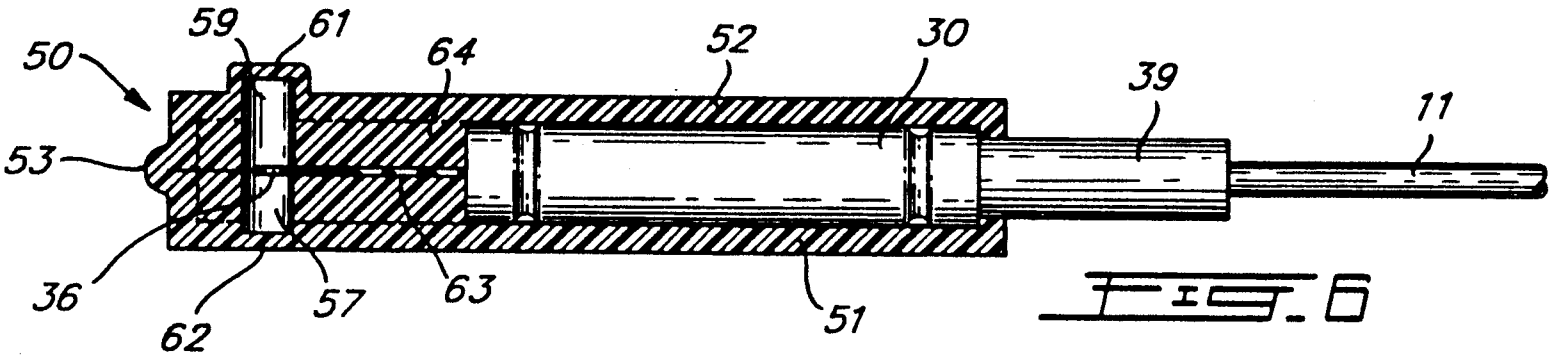
FIG. 6 is a longitudinal cross-sectional view of a closed connector body, an EBW initiator of the present invention, and a shock wave conductor.

Referring to FIGS. 5, and 6, there is shown a one-piece moulded plastic housing connector 50 comprising a base unit 51 and a cover unit 52 which is adapted to hold the EBW initiators of the present invention. Units 51 and 52 are joined together by flexible member 53, which member is a thinner piece of plastic, which is capable of bending 180 degrees without breaking. An upward extending skirt portion 54 is provided around the sides of base unit 51 so that, when assembled (as shown in FIG. 6), unit 52 is adapted to fit within the confines of skirt 54. Units 51 and 52 each contain a semi-cylindrical hollow area 55 and 56, respectively, adapted to receive and tightly clamp an EBW initiator 30 when the units 51 and 52 are folded together about flexible member 53. Contained within base unit 51 are hollow channels 57 and 58 which align with channels 59 and 60 in cover unit 52 when the units 51 and 52 are folded or placed together as shown in FIG. 6. The upward facing ends of each of channels 59 and 60 are each closed off by integral, raised plastic button elements 61 while the downward facing ends of each of channels 57 and 58 are sealed by means of an integral, rupturable, plastic membrane 62. Within units 51 and 52 are integral platforms 63 and 64, respectively, which platforms are adapted to clamp therebetween lead wires 36 and 37. Wires 36 and 37 are held in a position between platforms 63 and 64 so that their ends extend into the hollow area defined by channels 57 and 58. The faces of platforms 63 and 64 may be provided with indented tracks to aid in the positioning of lead wires 36 and 37. Integral pins or posts 65 on base unit 51 are adapted to fit tightly into openings 66 within cover unit 52 in order to secure units 51 and 52 together in the folded position shown in FIG. 6. Shock wave conductor 11 is shown leading from one end of EBW initiator 30 and exiting from bushing 39.

Figure 7:
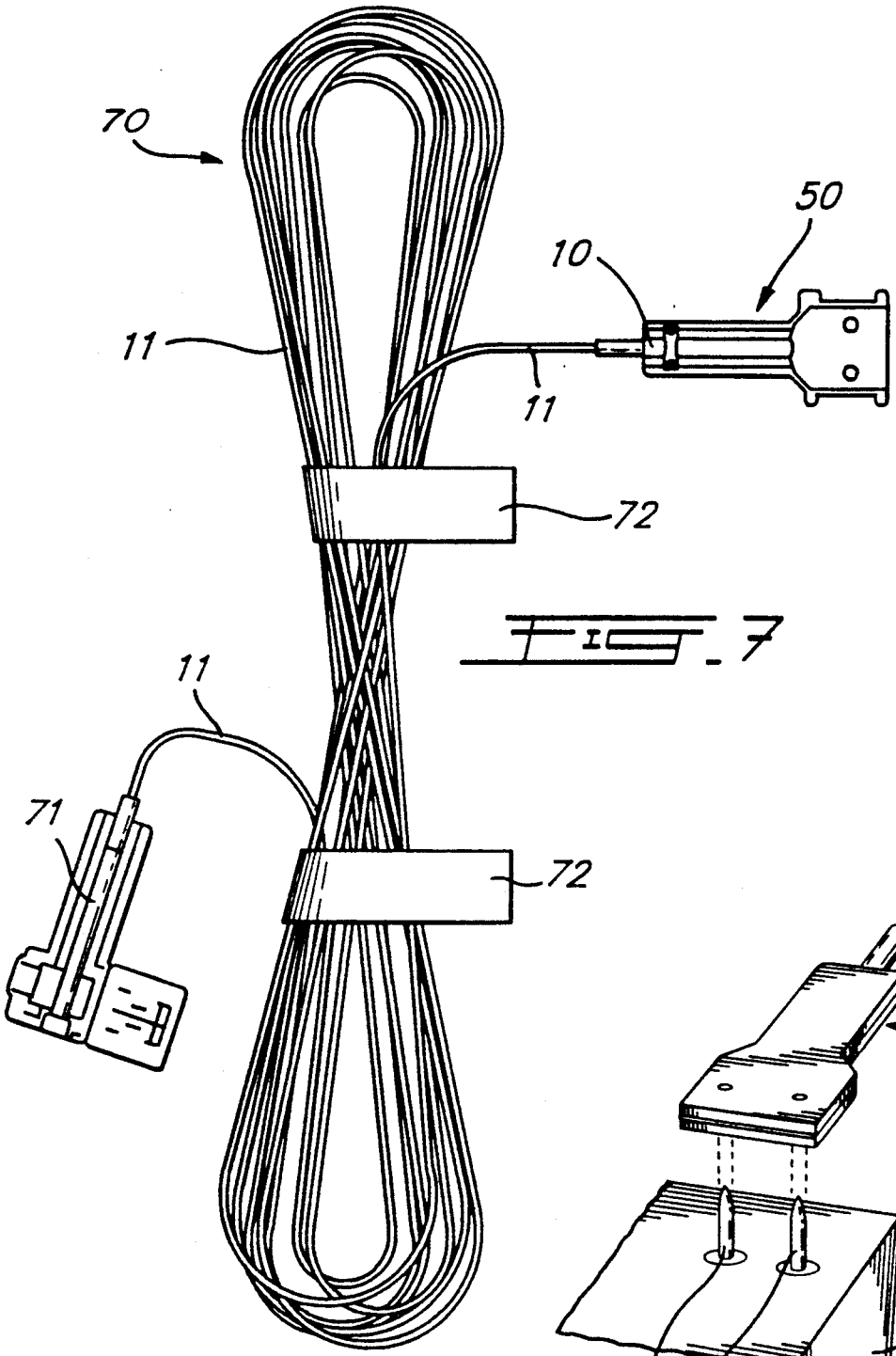
FIG. 7 is a perspective drawing of a completed initiator assembly according to the present invention in ready-to-use form.

Prior to use in the field in conjunction with an appropriate electric current generator, an assembly 70 of the invention, as shown in FIG. 7, is prepared by:

(a) selecting a desired length of shock wave conductor 11;

(b) securing a non-electric, shock wave initiated blasting cap 71 to one end of conductor 11 in a fashion known within the blasting industry; and (c) securing an electrically initiated EBW initiator 30 of the present invention, contained in connector body 50, to the opposite end of conductor 11. The shock wave conductor can be coiled in order provide a convenient shipping arrangement and is maintained in a coiled position by pieces of tape 72.

Figure 8:
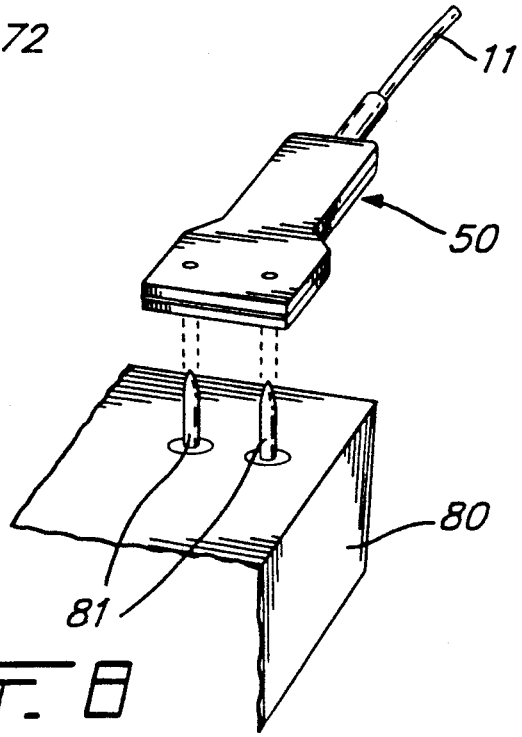
FIG. 8 is a perspective drawing of the connector body in association with a firing unit.

In FIG. 8, the connector body 50 is shown over a firing unit 80 which firing unit 80 has two connector pins 81. In connector 50, the EBW initiator 30 of the present invention is seated and clamped within the hollow area of connector body 50 in such a manner that lead wires 36 and 37 are held partly within the space defined by channels 57 and 58. When the blasting cap 71 of the assembly shown in FIG. 7 has been positioned to initiate an explosive charge or priming charge (not shown), connector body 50 is plugged into connector pins 81 of firing unit 80 so that connector pins 81 rupture membranes 62 on connector body 50. The connector pins 81 thus protrude into channels 57 and 58 and thus make electrical contact with lead wires 36 and 37. The firing unit may then be operated to generate an electric current which is delivered to connector pins 81. The current is passed from pins 81 to lead wires 36 and 37. The EBW initiator 30 is thus fired and, in turn, shock wave conductor 11 is energized to deliver an initiating energy wave to the connected blasting cap 71.

In order to plug connector body 50 onto connector pins 81, protective membranes 62 on unit 51 must be punctured. Although not essential to the functioning of the assembly, elements 61 and membranes 62 are provided to protect lead wires 36 and 37 within channels 57 and 58 and prevent any inadvertent contact between wires 36 and 37 and any stray source of electric current. Raised, elements integral buttons 61 on unit 52 also provide a convenient means of correctly identifying by touch the operable side or face of connector body 50.

In addition, connector body 50 can be fitted with protruding "tabs" on the sides or ends, which tabs correspond to protrusions on firing unit 80, in order to ensure that connector body 50 is correctly connected to firing unit 80.

The connector body 50 is conveniently made in a single piece by injection moulding methods from low density polyethylene. Alternatively, two separate body components 51 and 52 may be moulded. Assembly is carried out in the explosives factory and the unit may be supplied in a variety of lengths and having either instantaneous or delay blasting caps attached.

A particular advantage of the EBW initiator of the present invention is that lower electrical voltage is required to initiate a shock wave conductor in proximity therewith because the connection between the initiator and the energy source can be considerably shorter.

Testing of the exploding bridge wire initiator as described in FIG. 2 has consistently shown that a conventional shock wave conductor, available under the trade mark NONEL*. can be reliably initiated by an application of 100 D.C. volts to the EBW initiator of the present invention. Testing of the exploding bridge wire initiator with an unmodified 120 volts A.C. also successfully ignited the shock wave conductor on 7 of 10 attempts.

This low voltage level provides an advantage over the prior art in that low cost solid state switching devices may be employed in battery powered units.

In contrast, conventional EBW caps typically operate at 2000 to 4000 volts, which voltage level requires a triggered spark gap to switch the electrical energy to the EBW and, which voltage is not generally available from battery powered sources.

It will be readily understood by those skilled in the art that the EBW initiator of the present invention provides a substantially increased margin of safety over the use of conventional electric blasting caps for the initiation of shock wave conductors. In particular, the absence of any primary or secondary explosive in the device and the convenience of using a snap-together pre-formed and protected assembly can be noted.

We claim:

1. An initiation assembly comprising:

i) an elongated connector body;

ii) an electrically initiated exploding bridge wire initiator having an exploding bridge wire and lead wires connected with said bridge wire; and iii) a shock wave conductor which comprises a hollow elongated tube having an inner lining of a reactive material, wherein said connector body comprises two elongated, substantially excavated blocks adapted to form a container, the hollow inner portion of said container being shaped so as to receive therein said exploding bridge wire initiator and said lead wires, said lead wires being disposed so as to permit plug-together contact with current-carrying elements; and wherein said exploding bridge wire being sufficiently adjacent to said reactive material so that, on actuation of said exploding bridge wire, direct initiation of said reactive material is effected.

2. An initiation assembly as claimed in claim 1, wherein said shock wave conductor has an open end in close proximity to said bridge wire and aid bridge wire is outside of said open end of said shock wave conductor.

3. An initiation assembly as claimed in claim 2, wherein said bridge wire is axially aligned with said shock wave conductor.

4. An initiation assembly as claimed in claim 2, wherein said bridge wire is in parallel proximity to said shock wave conductor.

5. An initiation assembly as claimed in claim 2, adapted for the direct initiation of a shock wave conductor, said exploding bridge wire initiator comprising a member defining a duct having a first and second open end; an insert within said duct essentially dividing said duct into a first duct area and a second duct area; an exploding bridge wire located within said first duct area; and a shock wave conductor located within said second duct area so that an open end of said shock wave conductor is axially aligned with said bridge wire.

6. An initiation assembly as claimed in claim 5, wherein the said exploding bridge wire initiator additionally comprises a plug which effectively seals said bridge wire within said first duct area.

7. An initiation assembly as claimed in claim 5, wherein said initiator additionally comprises a particle-retaining, disintegratable diaphragm disposed between said bridge wire and said reactive material and separating said first duct area from said second duct area.

8. An initiation assembly as claimed in claim 5, wherein said initiator further comprises a bushing insert located within said second duct area to provide retention of said shock wave conductor within said member.

9. An initiation assembly as claimed in claim 5, wherein said member is a metal tube.

10. An initiation assembly as claimed in claim 5, wherein said bridge wire is caused to explode by the application of a sufficiently high D.C. voltage to effect direct initiation of said shock weave conductor.

11. An initiation assembly as claimed in claim 1 for use in explosive blasting operations further comprising a non-electric blasting cap operatively connected to a second end of said shock wave conductor.

12. An initiation assembly as claimed in claim 1, wherein said connector body electrically insulates said exploding bridge wire initiator.

13. An initiation assembly as claimed in claim 1, wherein said plug-together contact is provided by means of elongated cavities adjacent said lead wires and disposed to receive said current-carrying elements.

14. An initiation assembly as claimed in claim 13, wherein said elongated cavities are sealed by a puncturable dust protective membrane.

15. An initiation assembly as claimed in claim 1, wherein said excavated blocks are essentially mirror-images of one another.

16. An initiation assembly as claimed in claim 15, wherein said mirror-image blocks are joined together to form a one-piece unit.

* * * * *